US006688725B2

(12) United States Patent
Fukatsu et al.

(10) Patent No.: US 6,688,725 B2
(45) Date of Patent: Feb. 10, 2004

(54) BUILDING BOARD PRINTING APPARATUS

(75) Inventors: Mikio Fukatsu, Toyoake (JP); Tomoyoshi Yabe, Nagoya (JP)

(73) Assignee: Nichiha Corporation, Nagoya (JP)

( * ) Notice: Subject to any disclaimer, the term of this patent is extended or adjusted under 35 U.S.C. 154(b) by 0 days.

(21) Appl. No.: 10/079,581

(22) Filed: Feb. 22, 2002

(65) Prior Publication Data

US 2002/0118250 A1 Aug. 29, 2002

(30) Foreign Application Priority Data

Feb. 23, 2001 (JP) ..... 2001/048834

(51) Int. Cl.[7] ..... B41J 2/145; B41J 2/15
(52) U.S. Cl. ..... 347/40
(58) Field of Search ..... 347/40, 43

(56) References Cited

U.S. PATENT DOCUMENTS

| | | | | |
|---|---|---|---|---|
| 6,089,697 | A | 7/2000 | Tajika et al. | 347/43 |
| 6,467,870 | B2 * | 10/2002 | Matsumoto et al. | 347/19 |
| 6,530,647 | B2 | 3/2003 | Kubota et al. | 347/43 |

FOREIGN PATENT DOCUMENTS

| | | |
|---|---|---|
| JP | 03-013347 | 1/1991 |
| JP | 04-099688 | 3/1992 |
| JP | H06-155729 | 6/1994 |
| JP | H07-205489 | 8/1995 |
| JP | H08-216435 | 8/1996 |
| JP | H08-281975 | 10/1996 |
| JP | 09-001832 | 1/1997 |
| JP | 09-011509 | 1/1997 |
| JP | 09-201564 | 8/1997 |
| JP | H10-128213 | 5/1998 |
| JP | 10-128231 | 5/1998 |
| JP | 2002-011864 | 1/2000 |
| JP | 2000-289233 | 10/2000 |
| JP | 2000-318188 | 11/2000 |
| JP | 2002-137402 | 5/2002 |

OTHER PUBLICATIONS

Office Action dated Jun. 11, 2003 which issued in corresponding Japanese Application No. 2001–048834 (English translation of the concise explanation of the relevance).

* cited by examiner

*Primary Examiner*—Thinh Nguyen
(74) *Attorney, Agent, or Firm*—Shook, Hardy & Bacon, LLP

(57) ABSTRACT

The present invention dispenses with a plate for printing using an ink jet technology and provides a building board printing apparatus which is ready for a small-lots & multi-products manufactured systems. Each of printing heads 1, . . . M, . . . N comprises nozzle arrays arranged in a line, each of which jets an ink selected from a group of colors such as yellow (Y), magenta (M), cyan (C) and black (B). Each printing head is successively arranged in a vice scanning direction, while being shifted color by color. According to this, four printing heads positioned adjacent to one another in a vice scanning direction enable the use of print inks of four colors successively. Since a printing interval between different colors can be shortened in a vice scanning direction, it becomes possible to provide high-quality printing with low color deviation on building boards to be moved.

4 Claims, 5 Drawing Sheets

BUILDING BOARD PRINTING APPARATUS

BACKGROUND OF THE INVENTION

1. Field of the Invention

The present invention relates to a building board printing apparatus, and in particular to a building board printing apparatus, which uses ink jet printing technology without plate-making, and which is adapted for a small-lots & multi-products manufactured system.

2. Description of the Related Arts

In the field of industrial multi-color printing machines, a gravure printing machine has been currently in use. The gravure printing machine has four separated gravure printing rollers for multi-color printing, which colors are C-color (cyan), M-color (magenta), Y-color (yellow), and B-color (black). Each color printing is carried out sequentially. Namely, in gravure printing, multicolor printing is accomplished by using four printing rollers as plates.

In the field of office machines, ink jet printers have been developed to a high degree in Japan. By using ink jet printers, simultaneous full-color printing with extremely high image resolution has been realized without implementing any plates for printing. Ink jet printers have one printing head for jetting color-inks (C, M, Y, B) simultaneously. The printing head has many jetting nozzles which control the open & shut movements by piezo-vibrator elements having high responsibility for voltage.

Nevertheless, although ink jet printers are aimed at desk-top level printing, one defect is that they have slow printing speeds (e.g. it is presently the case that color printing of an A4 page takes 1 to 5 minutes).

Therefore, even though ink jet printers have a huge advantage in that they can realize good-quality simultaneous full-color printing with high resolution, when considering the application thereof to the building board color printing field, there are considerable difficulties involved in the direct introduction of these printers in their present form into this field.

Considering the industrial printing of building boards, in order to cope with high manufactured-line speed (e.g. 24 m/min.) and to cope with building boards having extremely large printing faces, which are incomparable with paper, it is necessary to arrange a large number of jetting nozzles in a direction orthogonal to the moving direction over a range sufficient to cover the width of building boards.

A method for color printing of building boards, which applies piezo-vibration technology and a drop ink jetted from each jetting nozzle, is disclosed in Japanese Publication of Unexamined Patent Application (kokai) Nos. 9-201564 and 10-128231.

Nevertheless, the disclosed printing head, having a large number of nozzles arranged thereon, jets only one color ink from each nozzle. Thus, it is necessary to separately install the plurality of printing heads corresponding to the number of colors in multi-color printing, and ink jet printing is carried out sequentially.

Japanese Publication of Unexamined Patent Application (kokai) 3-13347 discloses a full-color industrial printing method using a thermal jet technology. However, in this method, a recorded printing of a page width of 216 mm is performed at 16 dots/mm nozzle pitch. Thus, this device configuration is unsatisfactory for building board full-color industrial printing. That is to say, this method involves difficulties in fabrication with respect to the precision of nozzle pitch in a case where printing heads are extended to a broad object to be printed, and thereby results in high fabrication cost. Moreover, even where a printing head can be produced with high precision, the problem of long-term operation still remains. This could cause substantial impairment of productivity, since there is a need to remove the entire printing head for exchange or repair when pigmentation of a portion of a printing head, or malfunction of the electronic system occurs.

In contrast, Japanese Publication of Unexamined Patent Application (kokai) 4-99688 discloses a method involving industrial printing of a sheet-shaped object, in which a nozzle arrangement at a given pitch is realized with good precision by arranging a large number of small-scale printing heads having a given number of nozzles. However, in this method also, one printing head jetting one color of ink was divided into multiple small-scale printing heads so as to make a group printing head configuration. A number of group printing heads corresponding to the number of colors in multi-color printing use is also required herein.

Thus, with any one of the above-stated methods, problems remain with respect to the realization of a stable simultaneous full-color industrial printing.

As disclosed in Japanese Publication of Unexamined Patent Application (kokai) 9-11509 for example, regarding a printing head in office work equipment, four nozzle arrays, which comprise the given number of nozzles jetting inks of four colors such as cyan, magenta, yellow and black, are equipped on a particular printing head. With ink jet printers in office work equipment, the particular printing head simultaneously jets the color inks of the above four colors on a page. The printing head traverses the page without contacting the page to be printed.

Furthermore, as disclosed in Japanese Publication of Unexamined Patent Application (kokai) 9-1832, there also exists a printing head having each nozzle array arranged in parallel thereon, which jets each ink such as cyan, magenta, yellow and black.

However, all of these printing head configurations are only directed to a desk-top level paper printing and relate to a technology involving allowing a printing head to traverse across the face to be printed. Thus, there is no way to apply these technology to building board full-color industrial printing.

Where printing is performed while ink jet nozzles are arranged in a direction (a main scanning direction) orthogonal to the direction to which the building boards are moved, there is conventionally adopted a configuration that nozzle arrays jetting the same color are arranged in a main scanning direction. The nozzle arrays jetting the different colors are successively arranged in a vice scanning direction providing relatively large intervals. For this reason, where a full-color printing is performed using, e.g., inks of four colors, C, M, Y and B, building boards must be moved for a long distance, while the given pixel of the building board passes all of the nozzle positions jetting the four colors.

Hence, when the distance between nozzles jetting each color in the vice scanning direction is long, building boards may be displaced in the main scanning direction while the building boards are carried for the distance between nozzles, or the amount of deviation of printing position may be increased by mere fluctuation of building board moving velocity, thus resulting in reduction in the quality of printed image or pattern. On the other hand, to reduce the amount of deviation of printing position within a given range, a higher carrier precision of building boards is required in proportion to a distance between nozzles containing each color of ink.

SUMMARY OF THE INVENTION

Therefore, the present invention is directed to solve the above-stated problems, and an object of the present invention is to provide a building board printing apparatus capable of shortening the printing interval between different colors in a vice scanning direction to achieve a high-quality printing with low color deviation.

To accomplish the above object, the building board printing apparatus of the present invention comprises a plurality of printing heads having a plurality of colors of ink jet nozzle arrays arranged in a main scanning direction on a per color basis, wherein the printing heads are arranged in a vice scanning direction while being shifted in a main scanning direction on a color unit basis.

Moreover, the feature that the nozzle arrays are arranged in a line in a main scanning direction enables the entire building board to be printed using few nozzles.

Furthermore, the feature that the shift occurs color by color enables the printing heads to be orderly arranged in a diagonal direction, resulting in easy fabrication.

Still further, the feature that the plurality of colors consist of 4 colors enables high printing quality.

The specification includes part or all of the contents disclosed in the specification and/or drawings of Japanese Patent Application No.2001-048834, which is a priority application of the present application.

DESCRIPTION OF THE PREFERRED EMBODIMENTS

The preferred embodiments of the present invention are described in detail below, referring to the attached drawings.

Figure 1:
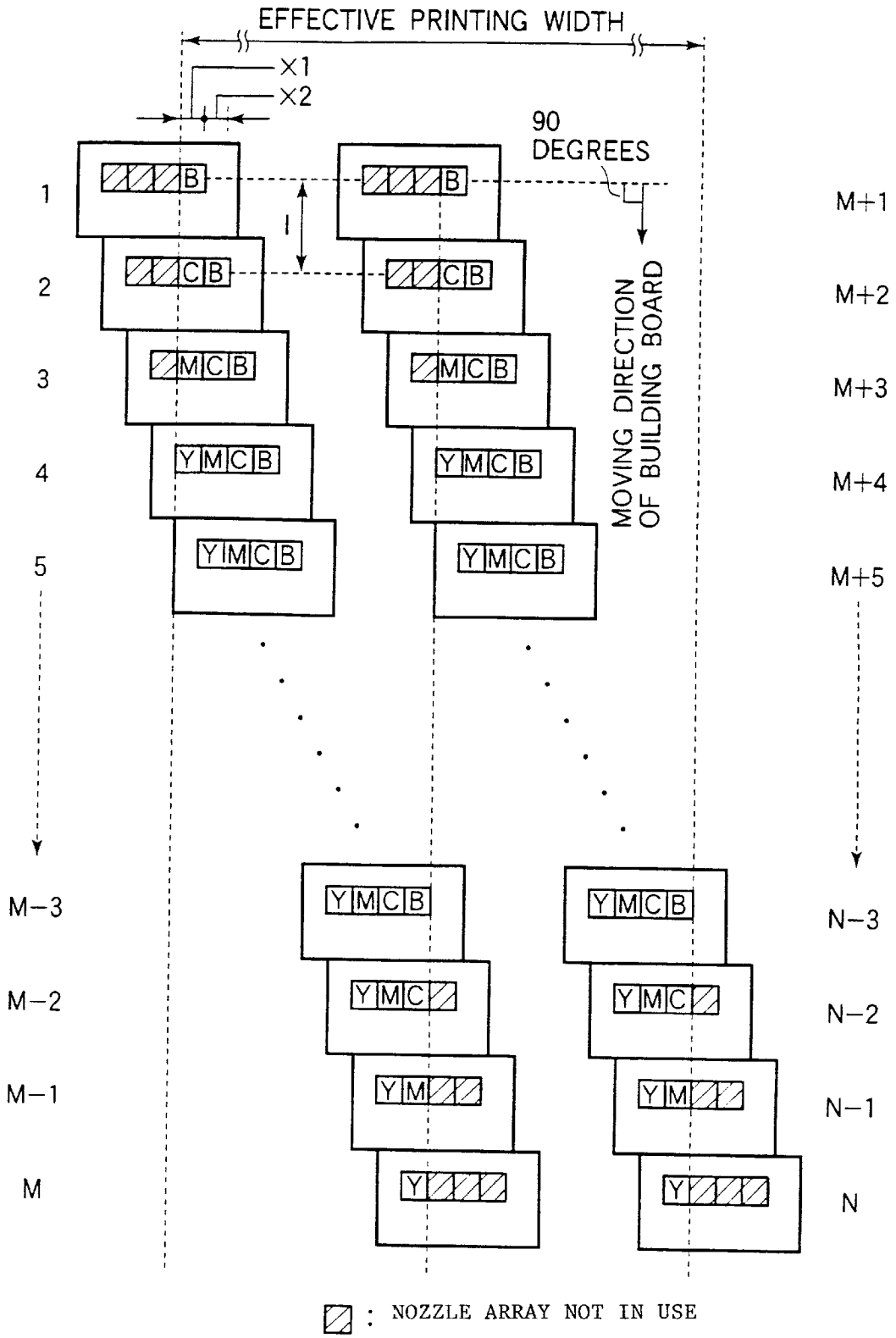
FIG. 1 is a figure showing the layout of printing heads of the building board printing apparatus of one embodiment of the present invention.

FIG. 1 is a figure showing the layout of printing heads of the building board printing apparatus of one embodiment of the present invention. The building board printing apparatus of the present embodiment comprises multiple printing heads arranged while being distributed in a main scanning direction and allows each of the fixedly arranged printing heads to take charge of a portion of the effective printing width of building boards. In addition, the building board printing apparatus of the present embodiment performs a vice scanning by moving the building boards to be printed at a certain velocity. Building boards are moved by a carrier conveyor, which is not illustrated, at a uniform velocity, v, at a certain position located directly underneath the printing heads.

Each multiple printing head (No. 1, . . . M, . . . N) is equipped with an ink tank which is not illustrated (the ink tank enables supply of ink by appropriate means). Due to the equipment of this ink tank, a printing head as a whole becomes larger than a nozzle array portion. However, a good arrangement precision (a distance between nozzles in adjacent printing heads: 1) is realized by forming the entire printing head as a rectangular parallelepiped housing. The illustration of a sequence fixing jig to fix printing heads in a line is omitted from FIG. 1.

Printing heads are fixed so that four consecutive nozzle arrays, each having a different color, are arranged in a line in a direction that the building boards move (are carried). As shown in FIG. 1, a portion of nozzle arrays that are not in use are determined, depending on an effective printing width. In the figure, hatched portions show nozzle arrays not in use.

In region x1 representing the given printing width at the left end in the figure regarding an effective printing width, printing is assigned to a nozzle array (having n nozzles) jetting an ink of color B in head No. 1, a nozzle array jetting an ink of color C in head No. 2, a nozzle array jetting an ink of color M in head No. 3, and a nozzle array jetting an ink of color Y in head No. 4. In region x2, which is adjacent to region x1, printing is assigned to a nozzle array jetting an ink of color B in head No. 2, a nozzle array jetting an ink of color C in head No. 3, a nozzle array jetting an ink of color M in head No. 4, and a nozzle array jetting an ink of color Y in head No. 5.

Figure 2:
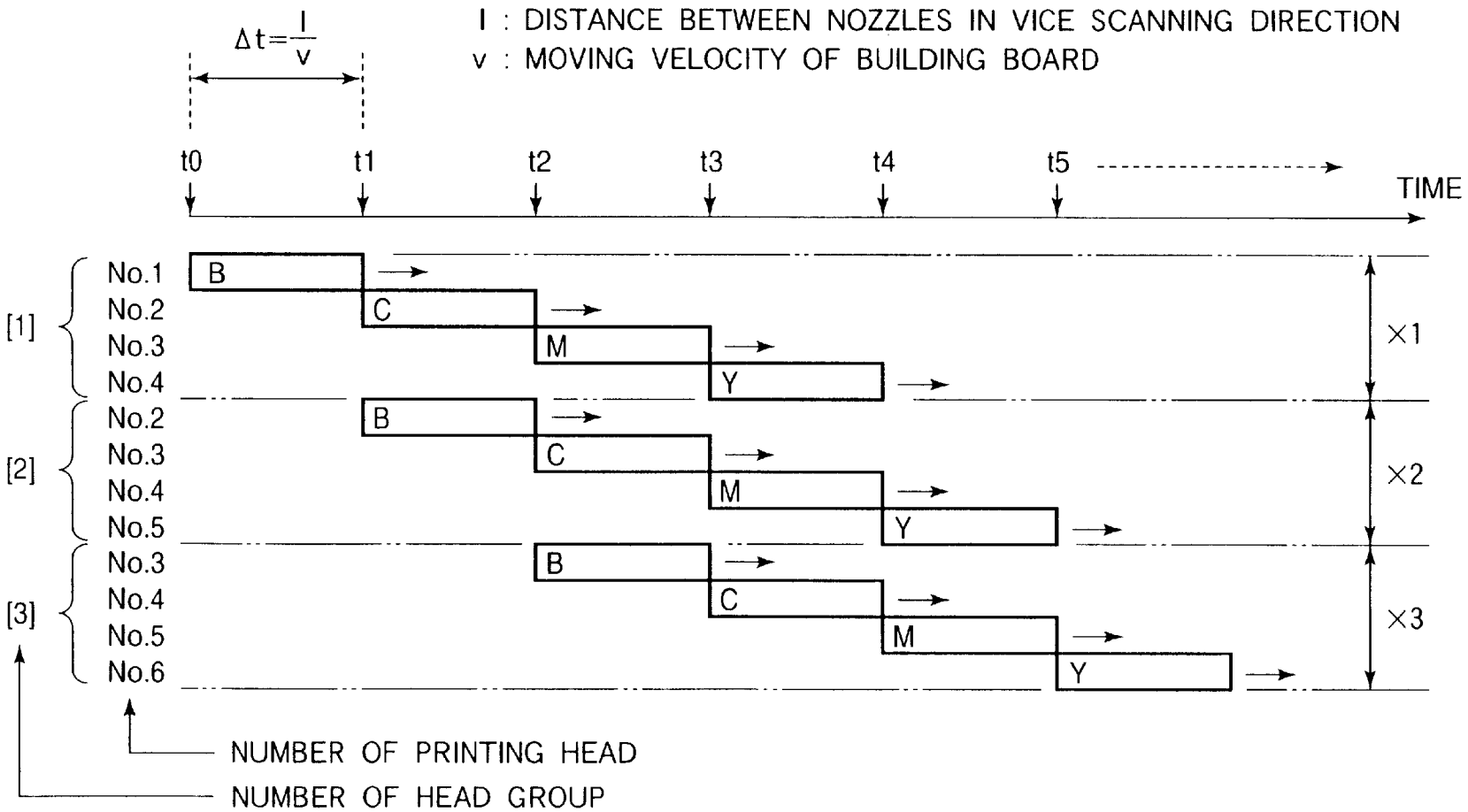
FIG. 2 is a figure showing the operation timing of each printing head.

FIG. 2 is a figure showing the operation timing of each printing head. As shown in FIG. 2, each printing head is actuated successively, having a time interval $\Delta t$. When heads Nos. 1 to 4, each taking charge of printing region x1, are defined as head group [1], heads Nos. 2 to 5, each taking charge of printing region x2, are defined as head group [2]. That is to say, one printing head belongs to multiple head groups in most cases. A time interval $\Delta t$ is determined by both distance 1 between nozzles arranged in a vice scanning direction and building board moving (carrying) velocity v. That is. $\Delta t=1/v$.

Figure 3:
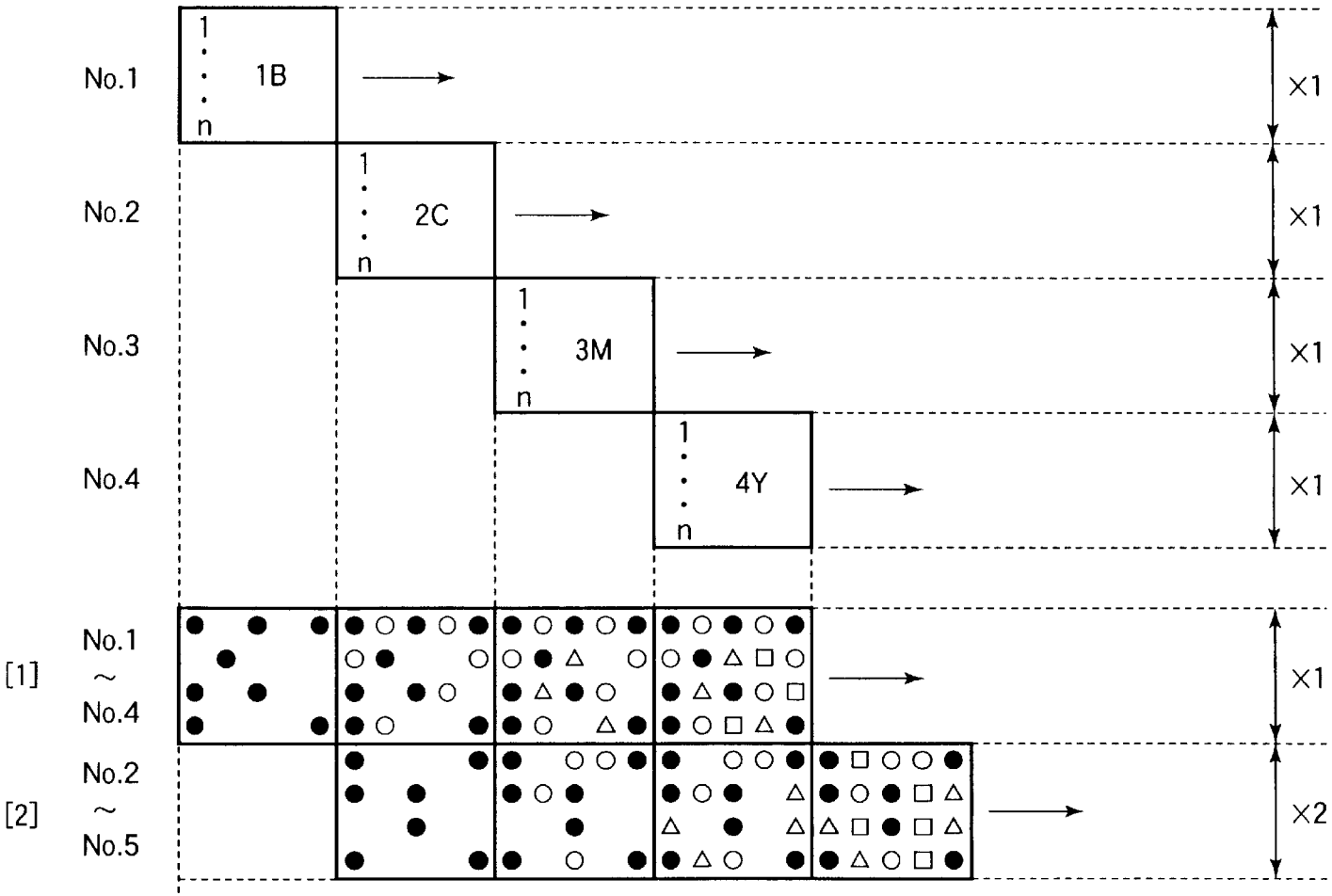
FIG. 3 is a figure showing schematically the change of printing status in each region of a printing width which is partially assigned to nozzle arrays jetting the ink of each color in a printing head.

FIG. 3 is a figure showing schematically the change of printing status in each region of a printing width which is partially assigned to nozzle arrays jetting the ink of each color in a printing head. The ink dot of each color is never overlapped. The distribution configuration of the ink dot of each color is determined in advance by a density control method. For example, where one pixel in a printing image is formed with four dots in a main scanning direction and five dots in a vice scanning direction, the position of dots of colors of C, M, Y and B are determined based on color data of the pixel.

In FIG. 3, a black circle represents the ink dot of B (black), a white circle represents that of C (cyan), a triangle represents that of M (magenta), and a square represents that of Y (yellow). Since this figure schematically shows a change of printing status, the number of ink dots differs from the actual situation.

Figure 4:
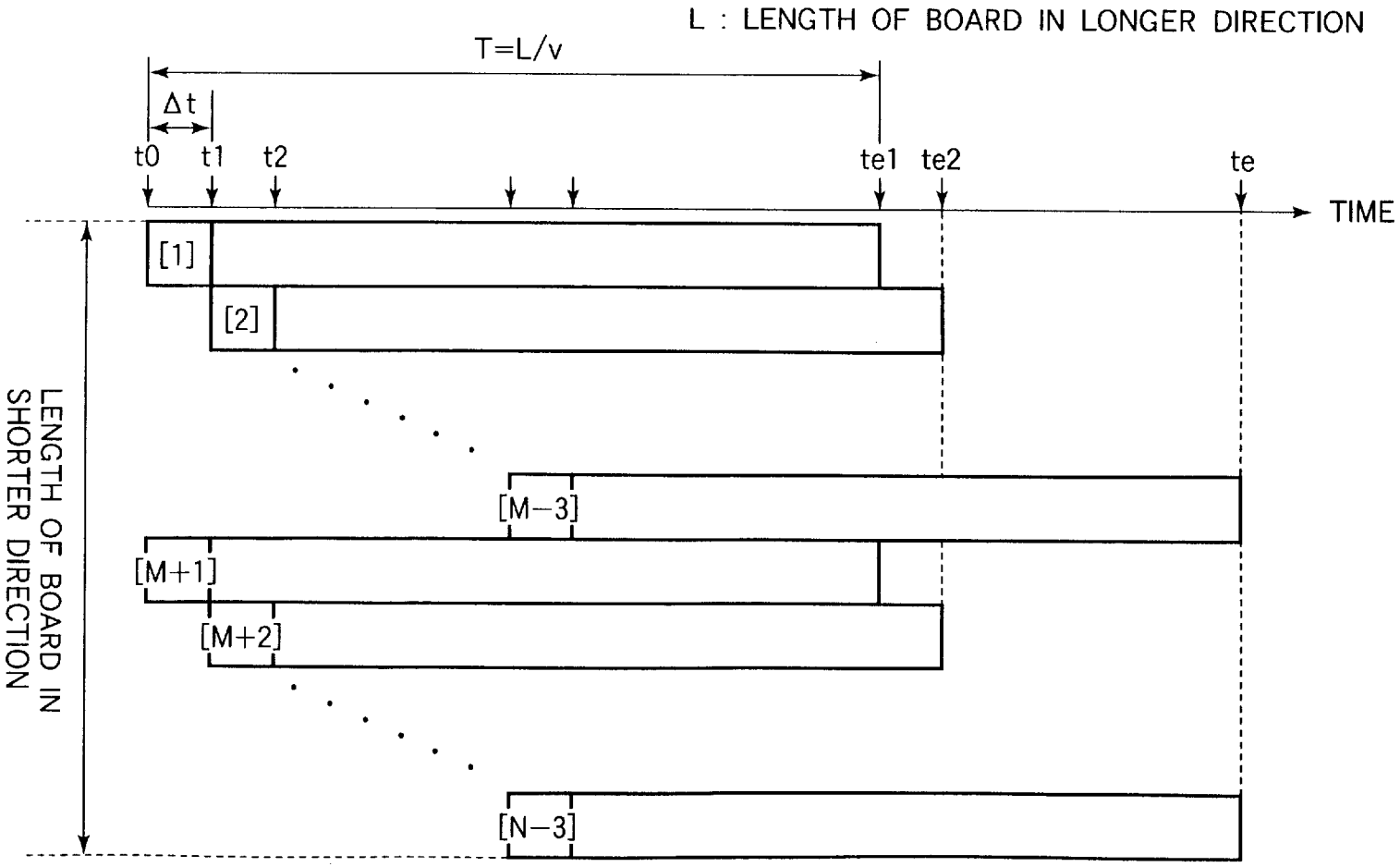
FIG. 4 is a figure showing schematically the concepts of printing control of a building board.

FIG. 4 is a figure showing schematically the concepts of printing control of a building board. Head group [1] is operated during a time from t0 to te1. Head group [2] is operated from t1 to te2. It is time te that the printing of a building board is completed by head groups [M−3] and [N−3]. That is, the printing from t0 to te is partially assigned to each head group.

Now, the above content of control and relative matters thereof are summarized.

Considering that building boards have a length of about 50 cm in a shorter direction under present circumstances, the printing heads used are comprised of one head line having heads Nos. 1 to M arranged diagonally and the other head line having heads Nos. M+1 to N arranged diagonally, which is in parallel with the former head line. Embodiments include a case of N=2M as shown herein, but are not limited thereto. Where two or more building boards are simultaneously moved in order to increase productivity, the necessary number of groups of head lines may simply be increased.

Head groups assigned to printing lines in a vice scanning direction are determined. For example, head group [1] takes charge of printing line x1.

Each head group is operated simultaneously with the corresponding head group in the head line arranged in parallel with each other.

The operation initiation time and the operation completion time of each head group are determined.

Each head group is comprised of four colors of printing heads arranged successively, and the operation initiation time and the operation completion time are determined for each of four colors of printing heads.

On each printing head, 1 to n number of jetting nozzles are arranged in parallel at the given nozzle pitch. The operation of each nozzle within a printing head operation time is determined by sequence data regarding dots of each color, which is obtained by a density control method based on calculation results of color separation of color subject copies.

Now, the above control is simulated using specific figures. When a nozzle switching frequency to jet 1 dot of ink is set at 10,000 times/sec., in order to jet 100 dots in 1 span (4 mm) in a vice scanning direction, that is, to set dot pitch at 0.04 mm, it takes 0.01 second to move a building board for a distance of 4 mm. According to this, a line speed (a conveyor speed) of 400 mm/sec., that is, 24 m/min. can be realized.

When the resolution in a main scanning direction is matched with the resolution in the vice scanning direction and the width of an assigned printing line is set at 4 mm, the number of nozzles on a corresponding printing head is 100. With this condition, if printing heads are formed having a distance of 4 cm between them in a vice scanning direction, the time ($\Delta t$) that a building board is moved over the 4 cm is 0.1 second.

Since there are four printing heads in a head group, operation time T of each head group is 1,800 mm÷400 mm/sec.+0.3 sec.=4.8 sec., if the length of a building board is set at 1,800 mm.

The specific execution operations are as follows:

(1) When it is confirmed that a print start horizontal line reaches a print start position, using a print start position detection sensor such as a photoelectric switch (t0), (2) Head groups [1] and [M+1] start an ink jet operation.

Specifically, in head group [1], first, head No. 1 starts its operation to jet an ink in accordance with its determined nozzle control pattern. Then, after time $\Delta t$ (0.1 sec.), head No. 2 starts its operation to jet an ink in accordance with its determined nozzle control pattern. Then, after time $\Delta t$, head No. 3 starts its operation to jet an ink in accordance with its determined nozzle control pattern. Further then, after time $\Delta t$, head No. 4 starts its operation to jet an ink in accordance with its determined nozzle control pattern.

Moreover, after a lapse of $T-3\times\Delta t$ (=4.8−0.3 sec.), head No. 1 completes its operation. After a lapse of $T-2\times\Delta t$ (=4.8−0.2 sec.), head No. 2 completes its operation. After a lapse of $T-\Delta t$ (=4.8−0.1 sec.), head No. 3 completes its operation. After a lapse of T (=4.8 sec.), head No. 4 completes its operation. And the same operation is simultaneously carried out in head group [M+1].

(3) Similarly, after a lapse of At from time to, head groups [2] and [M2] start those operations to jet inks.

(4) From then on, the unique operation of each head group is carried out at a time interval, until each of head groups [M−3] and [N−3] completes its operation.

Next, a specific control method is described.

Figure 5:
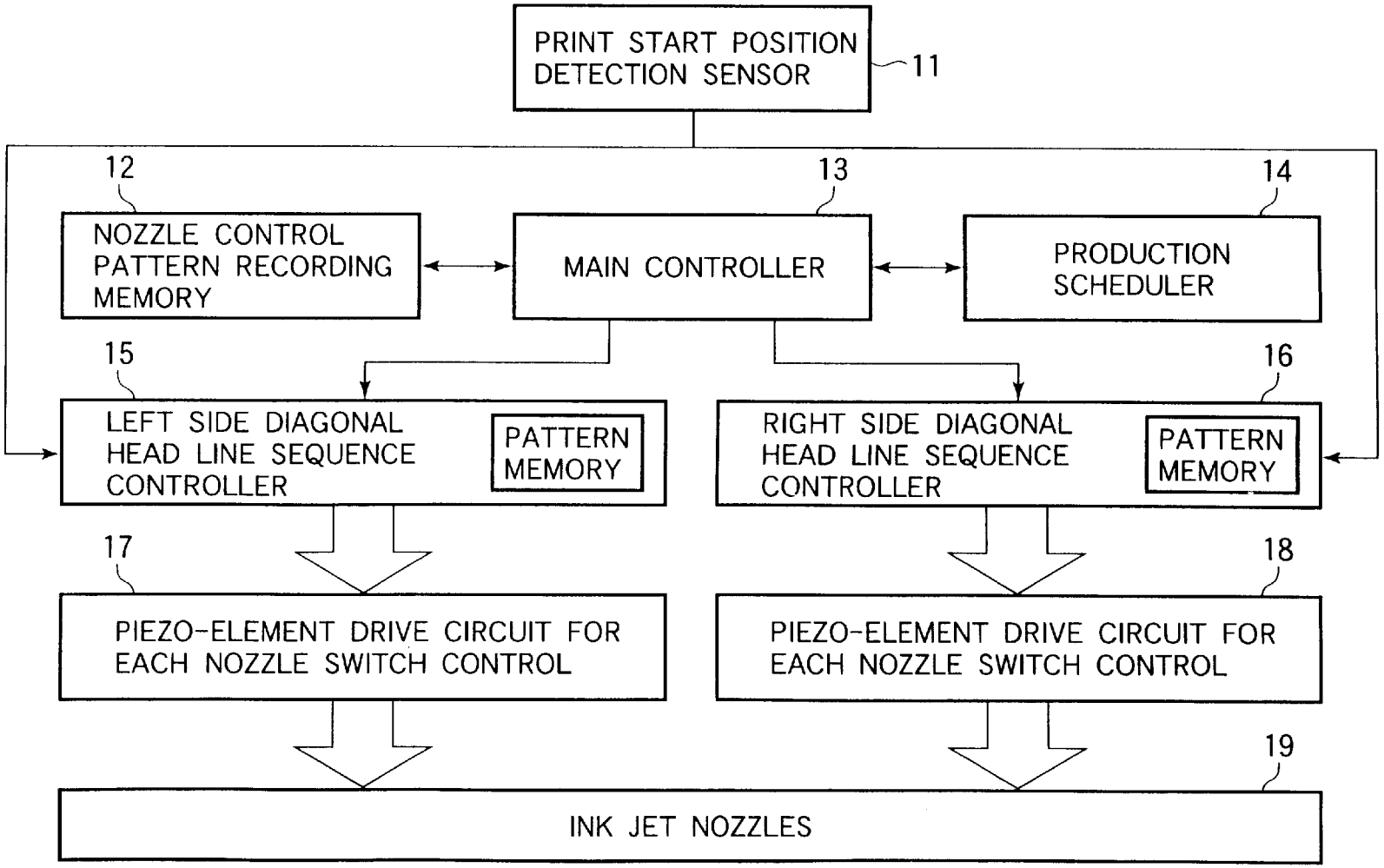
FIG. 5 is a block diagram of the building board printing apparatus of the present embodiment.

FIG. 5 is a block diagram of the building board printing apparatus of the present embodiment. In the present embodiment, a distributed control system configuration is applied, left side and right side diagonal head line sequence controller 15, 16 is provided for each diagonal head line, and these controllers are controlled by main controller 13. When print start position detection sensor 11 detects the print start position of a building board, each of diagonal head line sequence controllers 15, 16 actuates a piezo-element (not shown) provided for ink jet nozzles 19 by means of piezo-element drive circuits for each nozzle switch control 17, 18, and thereby ink dot is jetted from ink jet nozzles 19.

Main controller 13 determines a nozzle control pattern used in one production lot by the instruction from production scheduler 14, forms a control sequence corresponding to the production lot, and transmits it to each of diagonal head line sequence controllers 15, 16 to instruct control.

Nozzle control pattern recording memory 12 has a large amount of nozzle control pattern data recorded thereon (see FIG. 3). The data is obtained by performing color separation of color subject copies having several types of color designs prepared depending on the surface forms of building boards, and converting them by a density control method.

For example, assuming that four types of color designs a to d are made from building boards having an identical surface form in one lot, when production scheduler 14 instructs production of 20 building boards of color design a, 30 building boards of color design b, 40 building boards of color design c, and 10 building boards of color design d, in this order, main controller 13 reads 4 nozzle control patterns a to d, and sets a control sequence consisting of 20 repetition numbers of pattern a, 30 repetition numbers of pattern b, 40 repetition numbers of pattern c, and 10 repetition numbers of pattern d in this order. The main controller 13 transmits this control sequence to each of diagonal head line sequence controllers 15, 16 in order to perform an instruction.

Apparently, it is also possible to perform printing on building boards having two or more types of surface forms in one production lot.

The present invention can be an effective means to switch from a conventional large-scale fabrication system (a continuous painting system) to a small-lots & multi-products manufactured system. Specifically, it enables reduction of finished product stock by applying a fabrication method of continuously storing a scheduled amount of original building boards having various types of design faces (which include building boards including a joint portion and a groove portion such as a tile pattern and a brick-stack pattern), and according to actual demand, printing the given coloring pattern. This system can also be applied to high speed printing, and the printing quality (gradation expression) thereof is good.

The present invention is not limited to the above embodiment.

A line of nozzle arrays arranged in a main scanning direction sufficiently meets with requirements, but if multiple lines of nozzle arrays are provided in a vice scanning direction, it enables slowing of nozzle control.

In the above embodiment, a case of the application of four colors is described, but the application of three colors may also be available, and embodiments are not limited thereto.

In the above embodiment, a case that each printing head is arranged being shifted one color by one color is described.

However, it is not necessary to shift printing heads precisely in diagonal. For example, it is possible that printing heads are arranged first being shifted by two colors and then being put back by one color.

As stated above, the building board printing apparatus of the present invention can perform a building board printing with a quality close to a gravure printing or gravure offset printing, without using a physical plate. The building board printing apparatus of the present invention dispenses with a physical plate and so it is ready for a small-lots & multi-products manufactured system.

Moreover, in the building board printing apparatus of the present invention, where four color printing is performed, inks of four colors can be successively printed by four printing heads adjoined to one another in a vice scanning direction. High-quality printing with low color deviation can be performed by shortening a printing interval between different colors in a vice scanning direction.

All publications including patents and patent applications cited herein are incorporated herein by reference in their entireties.

What is claimed is:

1. A building board printing apparatus, comprising a plurality of printing heads having a plurality of colors of ink jet nozzle arrays arranged in a main scanning direction on a per color basis, wherein said printing heads are arranged in a vice scanning direction while being offset in a main scanning direction on a color unit basis.

2. The building board printing apparatus according to claim 1, wherein said nozzle arrays are arranged in a line in a main scanning direction.

3. The building board printing apparatus according to claim 1, wherein the shift occurs color by color.

4. The building board printing apparatus according to claim 1, said plurality of colors consisting of four colors.

* * * * *